US011554842B1

(12) United States Patent
Girardin

(10) Patent No.: US 11,554,842 B1
(45) Date of Patent: Jan. 17, 2023

(54) FOLDABLE KITE OR WING

(71) Applicant: KLDG B.V., Noordwijk (NL)

(72) Inventor: Damien Henri Constant Girardin, Pala, HI (US)

(73) Assignee: Reedin International BV, Noordwijk (NL)

( * ) Notice: Subject to any disclaimer, the term of this patent is extended or adjusted under 35 U.S.C. 154(b) by 0 days.

(21) Appl. No.: 17/896,262

(22) Filed: Aug. 26, 2022

Related U.S. Application Data

(60) Provisional application No. 63/247,516, filed on Sep. 23, 2021.

(51) Int. Cl.
*B63H 8/12* (2020.01)
*B63B 32/40* (2020.01)

(52) U.S. Cl.
CPC ..... *B63H 8/12* (2020.02); *B63B 32/40* (2020.02)

(58) Field of Classification Search
CPC ... B63H 8/00; B63H 8/12; B63H 9/00; B63H 9/06; B63H 9/0685; B63B 32/40; B64C 31/00; B64C 31/06
USPC ..... 114/102.11
See application file for complete search history.

(56) References Cited

U.S. PATENT DOCUMENTS 4,708,078 A * 11/1987 Legaignoux ..... B63H 8/12 114/102.23
7,093,803 B2 * 8/2006 Culp ..... B63H 9/071 244/152
9,511,836 B2 * 12/2016 Berrang ..... B63H 8/12

* cited by examiner

*Primary Examiner* — Lars A Olson
(74) *Attorney, Agent, or Firm* — Eric P. Mirabel

(57) ABSTRACT

Disclosed is a kite or wing with a canopy made of a film material which cannot be folded without being creased but having one or more strips of flexible material running across the canopy, wherein the flexible material can be folded without creasing, The kite or wing can be folded along the flexible material strips and then rolled up from the canopy ends for storage or transport.

10 Claims, 14 Drawing Sheets

FOLDABLE KITE OR WING

BACKGROUND

Kites and wings are structures used for wind sports. Their canopies are usually formed from woven canopy material (e.g., Ripstop™) that can easily be folded or creased for size reduction, to fit for example, into a relatively small bag for transport or storage. Canopies can also be made of materials that cannot be creased, but can be tightly rolled up.

Typical woven canopy materials stretch excessively when filled with wind and under load, so the profile (known as the camber or foil) of the wing changes dramatically in use in wind. The canopy foil controls the force of its lift (for a wing or a kite) or its pull/push force (for a sail). Accordingly, changing the foil in use dramatically affects the canopy performance characteristics. Due to the stretching, the canopies will often flutter in use; whereby the fluttering portions are not in a foil conformation and are not lifting or pushing/pulling. Moreover, the stretching leads to permanent deformation of the canopy material and the foil.

Thus, what is needed is a wing or foil constructed to hold the foil shape in use, and which doesn't stretch, and which can be easily folded to a compact size for transport or storage without damaging the canopy or the structure.

SUMMARY

A film material for the canopy should hold a consistent foil shape even under high wind conditions in use, such that it will not flutter in use, and will not permanently stretch out of shape. Such film materials include laminates made by Dimension-Polyant known as X-PLY, Code Zero, or Challenge Sailcloth, known as TNT X-ply, which can have a weave or grid material made of thick yarn or fibers glued between two layers of thin preferably transparent film. The fibers in between the layers of film can be made of different types of plastic material such as polyester, Spectra, Dyneema, Ultra-PE, polyethylene or carbon. The material can also be "monofilm" which is only one layer of preferably transparent film with no weave or grid material in between. While substantially transparent material is preferred for the uses herein, the material can be opaque as well.

Unfortunately, X-PLY and similar laminates and materials can be damaged by creasing upon folding. If not folded, the canopy remains consistent and such a canopy provides enhanced stability in use, and also provides the user a faster ride with greater wing lift, and with greater ability for the rider to move upwind (in the direction of the low pressure side, i.e., the convex side of the foil).

So as noted, if the film materials is folded, that will generate a permanent crease in the material; which damages the material and its performance. However, such film materials should preferably be tightly rolled for transport or storage. Canopies have a plurality of struts and can have battens running transverse to the longest wing dimension, some of which can be rolled into the canopy rolls.

The battens are preferably made of a semi-rigid but flexible material, such as fiberglass, vinyl, or carbon fiber. Such battens are preferably no longer than the longest dimension of the container they fit into upon folding for storage; as such battens cannot be folded on themselves without breaking.

The canopy preferably also has a support for the leading edge for the canopy material, which preferably runs along and forms the leading edge of the wing or kite. It preferably further includes a center strut running transverse to the longest dimension of the wing and bisecting the wing. The supporting leading edge can continue to run past the ends of the leading edge of the canopy and directly to the trailing edge of the canopy. The supports and struts are preferably in the form of an inflatable housing which becomes semi-rigid upon inflation. The battens could be such an inflatable housing as well, instead of a semi-rigid material.

The preferred canopy also has one or more strips of conventional flexible canopy material (typically made of Dacron, polyvinyl chloride, polyurethane or polyethylene) which can be folded without creasing, running lengthwise along the wing. Additional components, such as handles, can also be integral with or attached to the structure. More preferably, two or more handles are attached to the inflatable center strut.

For storage, the wing is first folded along the fold strip (lengthwise) and then rolled up from one or both ends towards the middle, with the battens encompassed within the rolls. The wing or kite made as described above is not damaged by the packing process due to the strip of foldable material, but can still be fitted into a much smaller bag than would be normally possible for wings or kites made exclusively of non-foldable materials or not including the battens with dimensions as noted above.

DETAILED DESCRIPTION

The film material used in the wings and kites of the invention can be any of a number of types of films which maintain good performance and tend not to stretch in use, including laminates where woven polyester fibers are glued between two layers of a thin transparent film, similar to Code Zero PES (made by Dimension-Polyant GmbH; Kieler Woche, Germany). The benefits of these laminate film materials stem from their ability to keep their shape without stretching. This significantly improves performance for the rider, as they won't lose the foil shape in use, generating more power per square meter of wing. A stretched wing will flutter instead of providing driving force. The wing is therefore easier to manage in high wind conditions, and easier to use for riding upwind. The wing also provides higher speeds and allows bigger jumps. It is also more resistant to small tears from contact with other objects.

Figure 1:
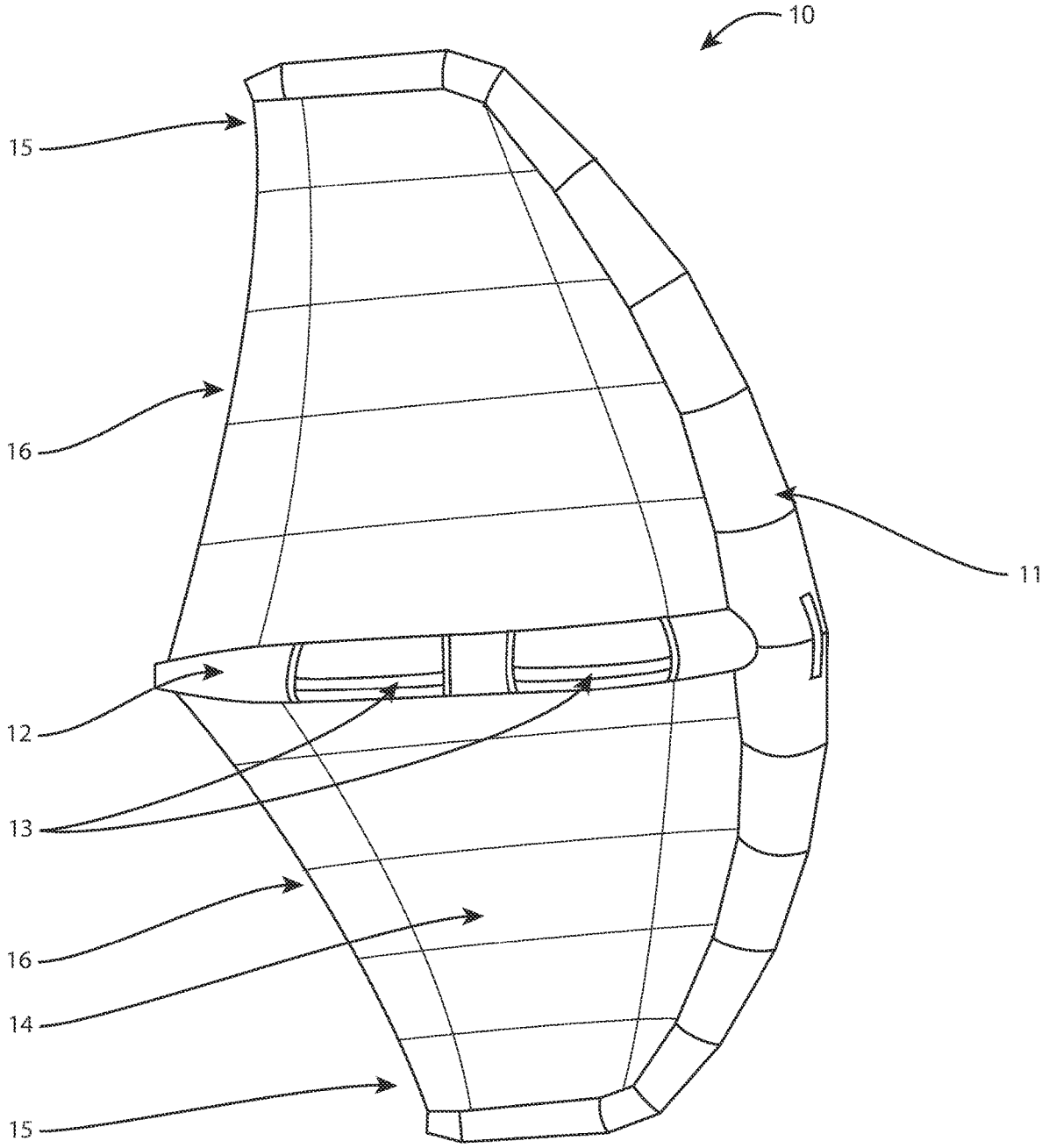
FIG. 1 is a perspective view of one side of a first embodiment of a conventional hand-held wing.

FIG. 1 shows a conventional hand-held wing 10 used for the sport known as wing foiling, wing surfing, wing riding, winging or wing-skiing. The wing is preferably used to propel a platform (a paddle board or surfboard) supporting a user's weight, but it is preferably used with a platform for the user attached to a hydrofoil, wherein the hydrofoil elevates the platform and the user at a threshold speed relative to the ambient water. The conventional wing has an inflated housing forming leading edge 11, a center strut 12 that supports two handles 13, and a main canopy 14 having wingtips 15 and trailing edge 16. The canopy of this conventional hand-held wing is made of material that can be folded without damaging it, for packing and transport purposes. Such materials however tend to stretch easily over time or even in use, which leads to performance decrease where the wing will flutter instead of providing propulsion.

Figure 2:
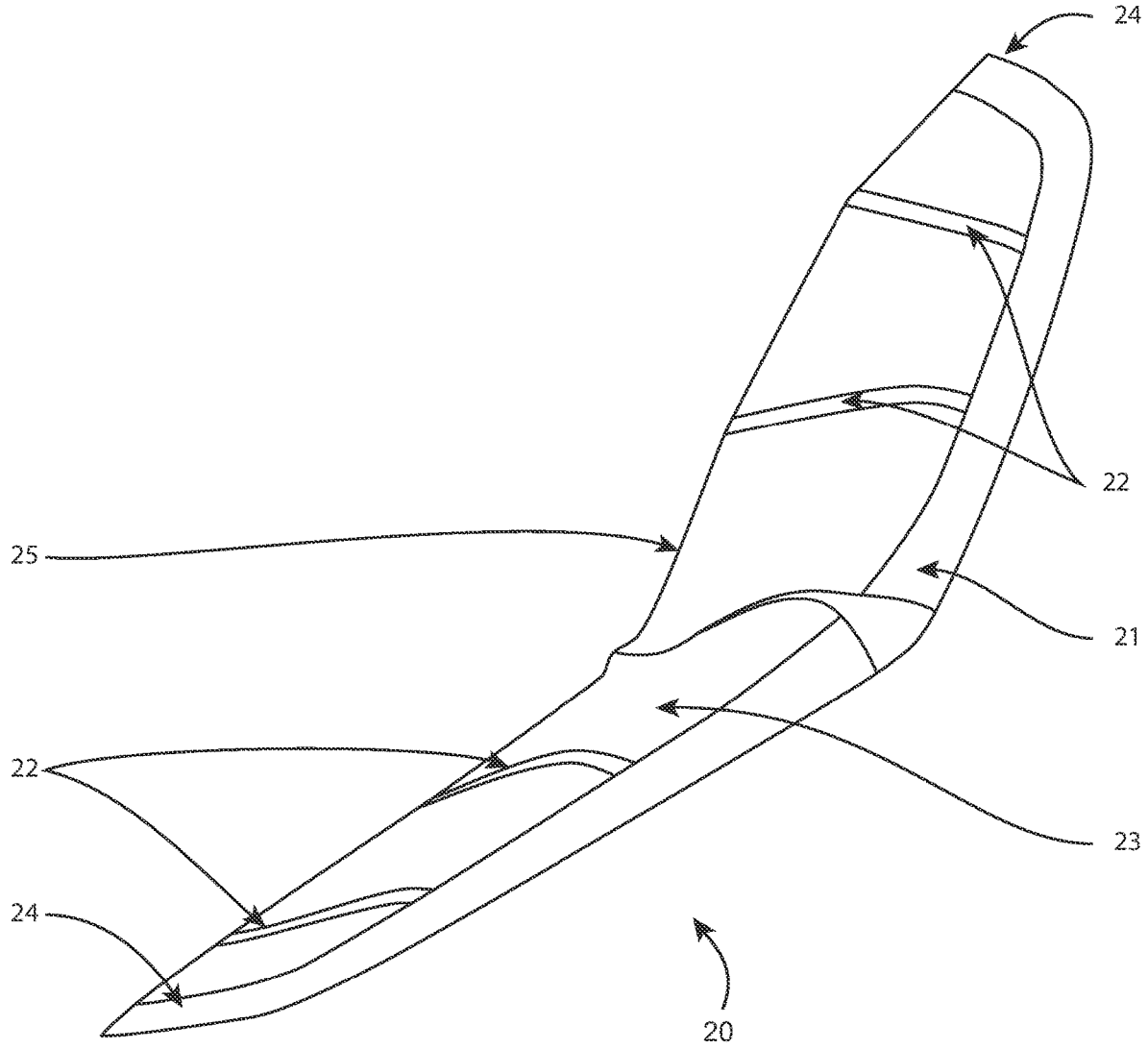
FIG. 2 is a perspective view of one side of a second embodiment of a conventional hand-held wing.

FIG. 2 shows another conventional hand-held wing 20 embodiment with a rigid (non-inflatable) leading edge 21, battens 22, and having a canopy 23 with wingtips 24 and trailing edge 25.

Figure 3:
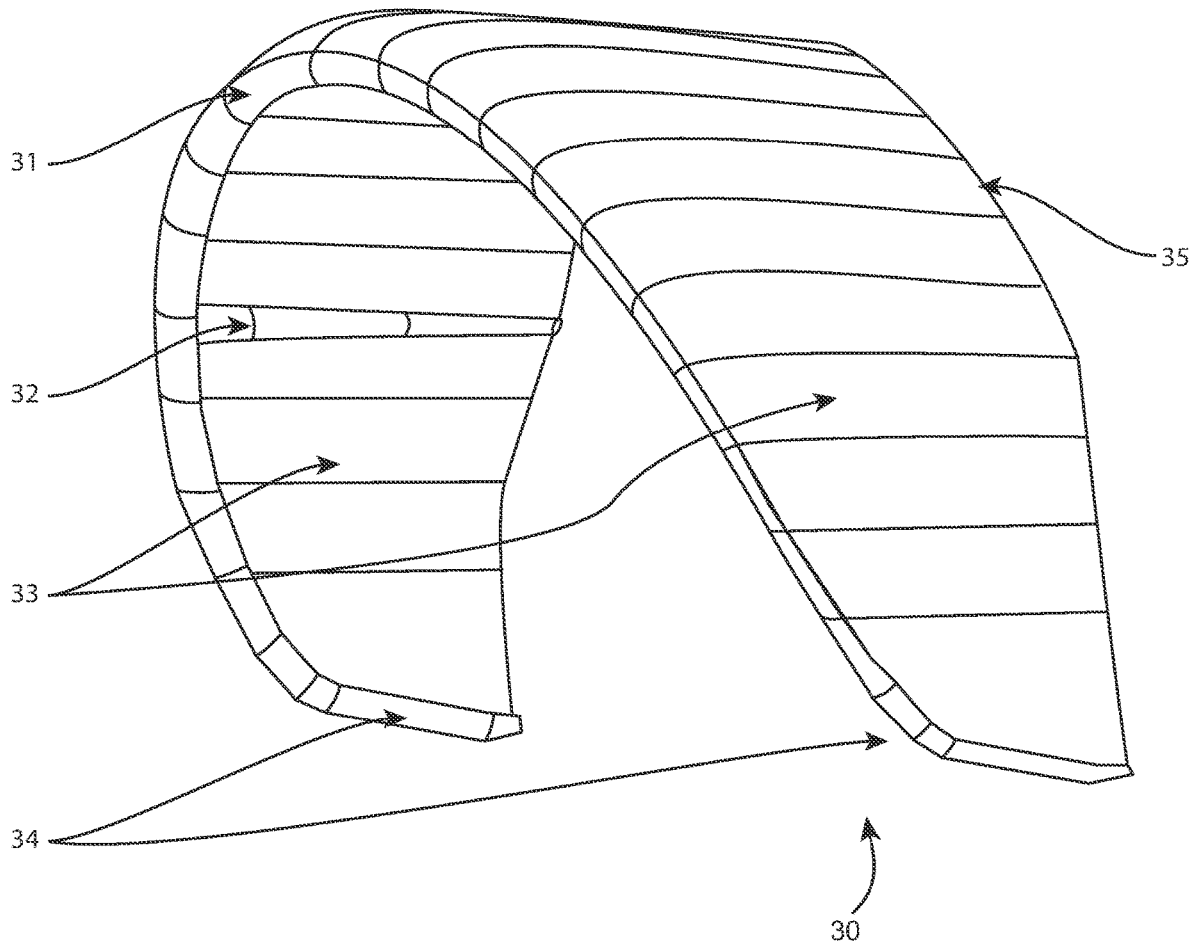
FIG. 3 a perspective view of a conventional kite.

FIG. 3 shows a conventional kite 30 used for the sport of "kitesurfing" or "kiteboarding"; with an inflated leading edge 31, inflated struts 32 and having a canopy 33 with wingtips 34 and a trailing edge 35.

Figure 4:
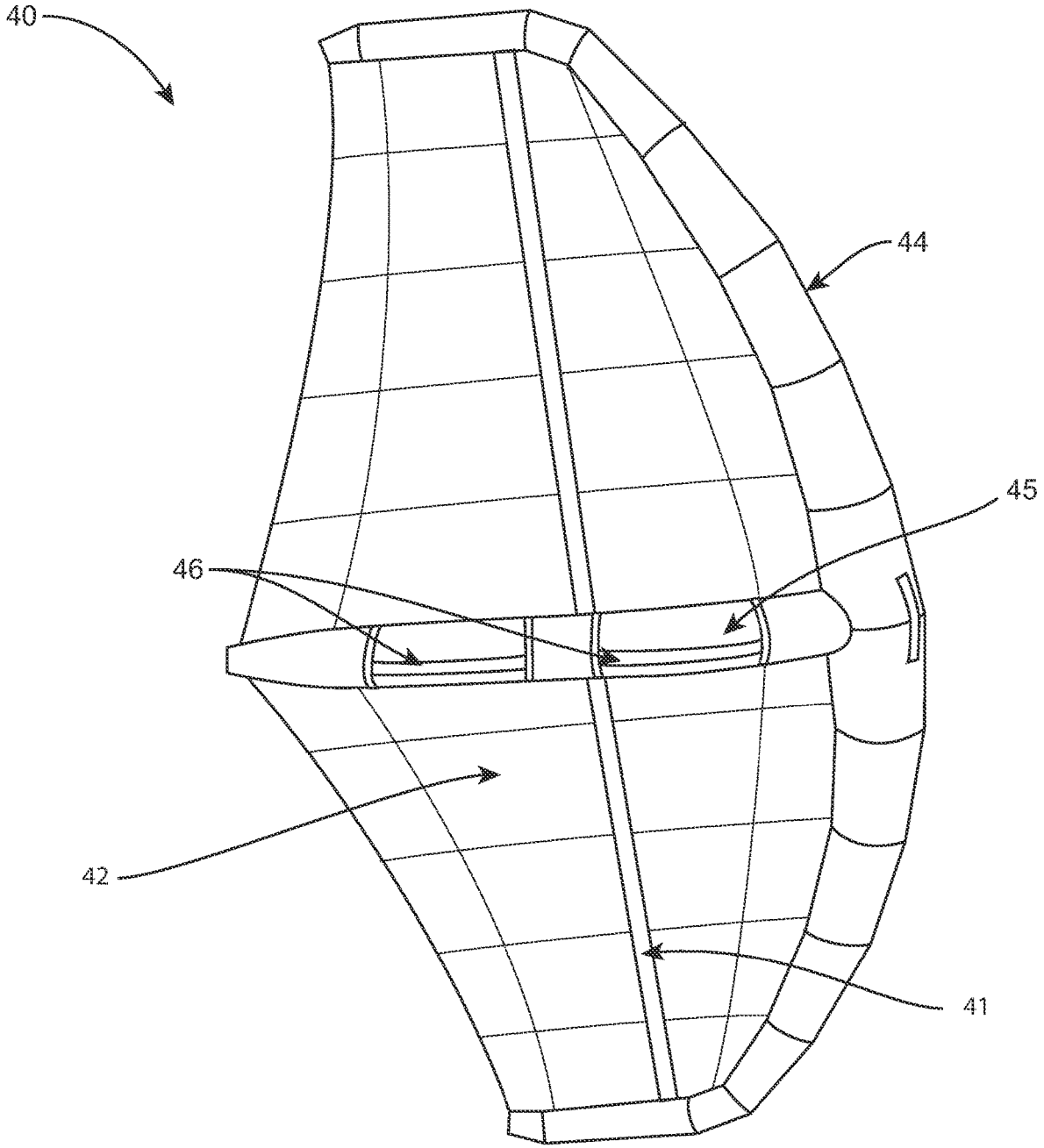
FIG. 4 is a perspective view of one side of a first embodiment of a hand-held wing of the invention.

FIG. 4 is a first preferred embodiment of a wing 40 of the invention where canopy 42 includes a longitudinal strip 41 made of foldable material, attached to adjacent sections of a film material; which is preferably a laminate (e.g. X-PLY) and can be damaged if creased. Wing 40 also includes an inflatable housing forming the leading edge 44 (preferably with an inflatable bladder inside, not shown) and handles 46. Preferably, the center strut 45 is also inflatable, and can be inflated through an airway connection with inflatable leading edge 44 or through separate connections to its internal inflatable bladder (not shown).

Figure 5:
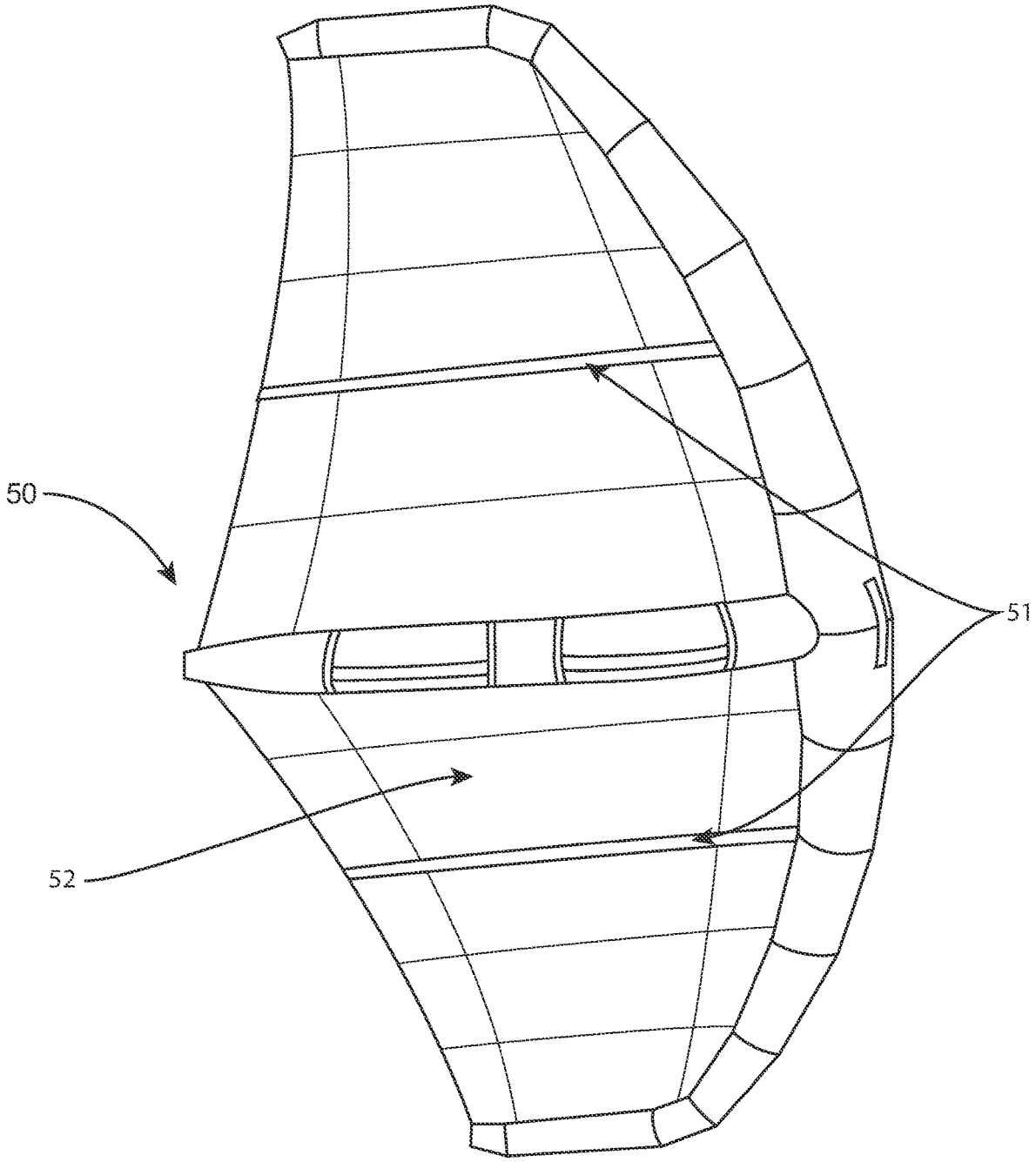
FIG. 5 is a perspective view of one side of a second embodiment of a hand-held wing of the invention.

FIG. 5 is an embodiment of a wing 50 of the invention with a canopy 52 which is otherwise like canopy 42 but further includes two transverse strips 51 of foldable material attached to adjacent sections of a laminate material.

Figure 6:
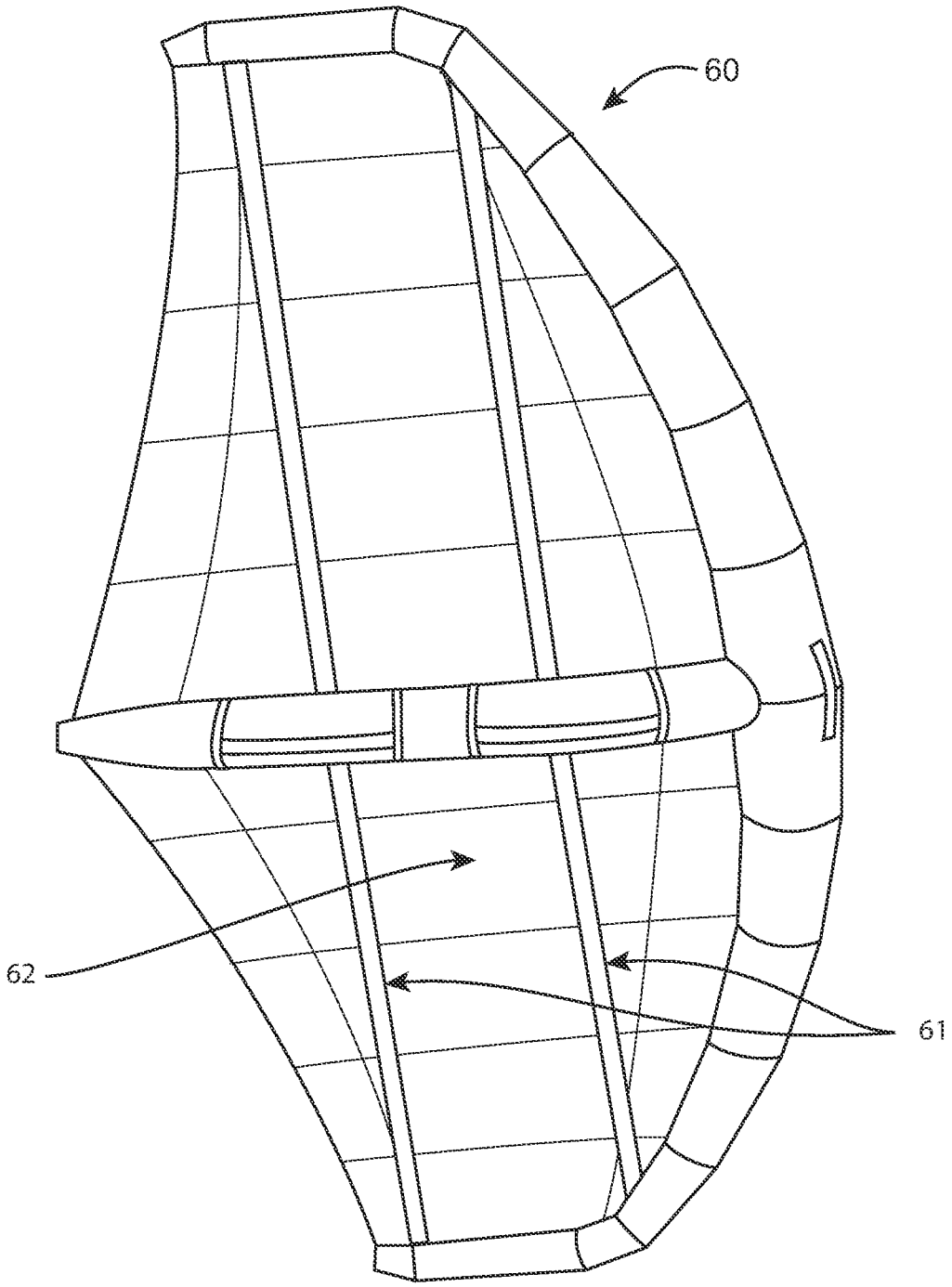
FIG. 6 is a perspective view of one side of a third embodiment of a hand-held wing of the invention.

FIG. 6 is another embodiment of a wing 60 of the invention where canopy 62 includes two longitudinal strips 61 of foldable material attached to adjacent sections of a laminate material, to allow canopy 61 to be folded along both strips 61 without damaging it (thereby further reducing the size of canopy 62 for storage and transport).

Figure 7:
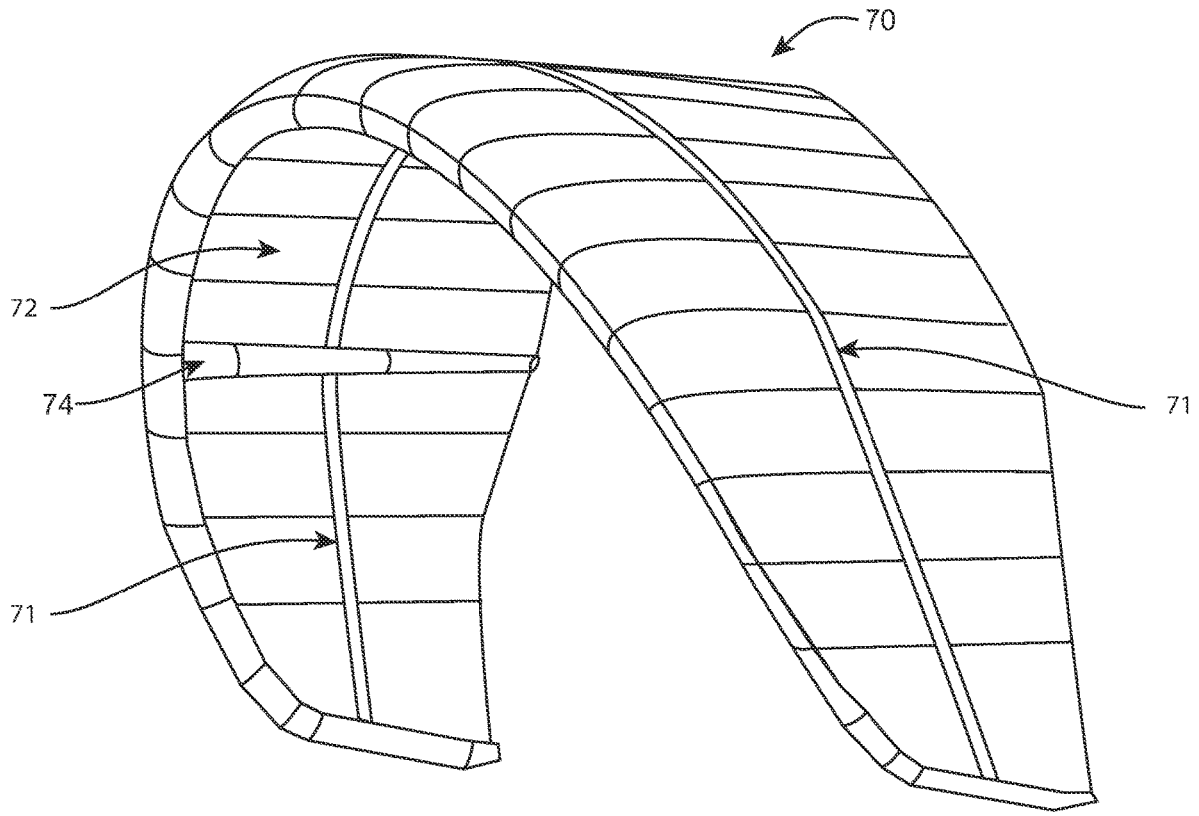
FIG. 7 is a perspective view of an embodiment of a kite of the invention.

FIG. 7 is another embodiment of a kite 70 of the invention similar to the shape of canopy 33 in FIG. 3, but which can have no struts, one strut or multiple struts 74; and wherein canopy 72 includes a longitudinal strip 71 of foldable material attached to adjacent sections of a laminate material.

Figure 8:
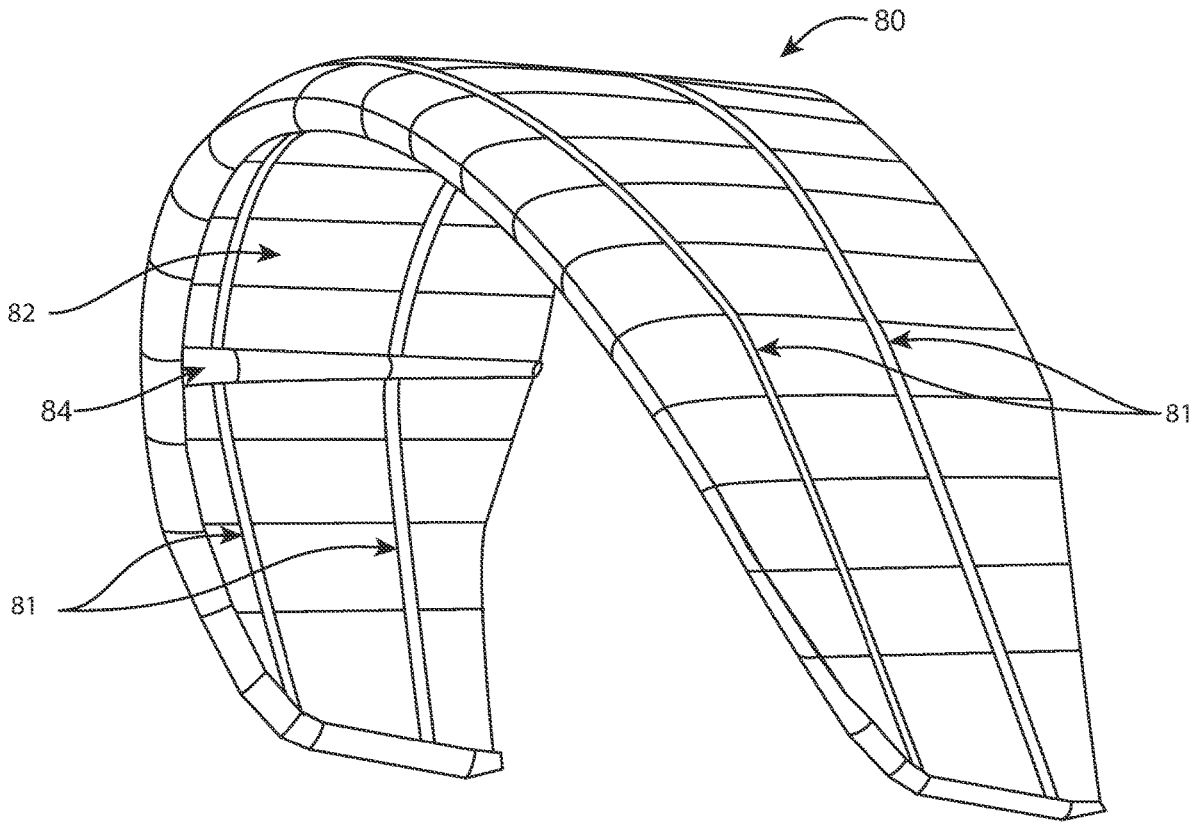
FIG. 8 is a perspective view of an embodiment of a kite of the invention.

FIG. 8 is another embodiment of a kite 80 of the invention similar to kite 70. Kite 80 can have no struts, one strut or multiple struts 84; wherein canopy 82 includes two longitudinal strips 81 of foldable material attached to adjacent sections of a film material; to allow kite 80 to be folded along both strips 81 without creasing or damaging it (thereby further reducing the size of kite 80 for storage and transport).

Figure 9A:
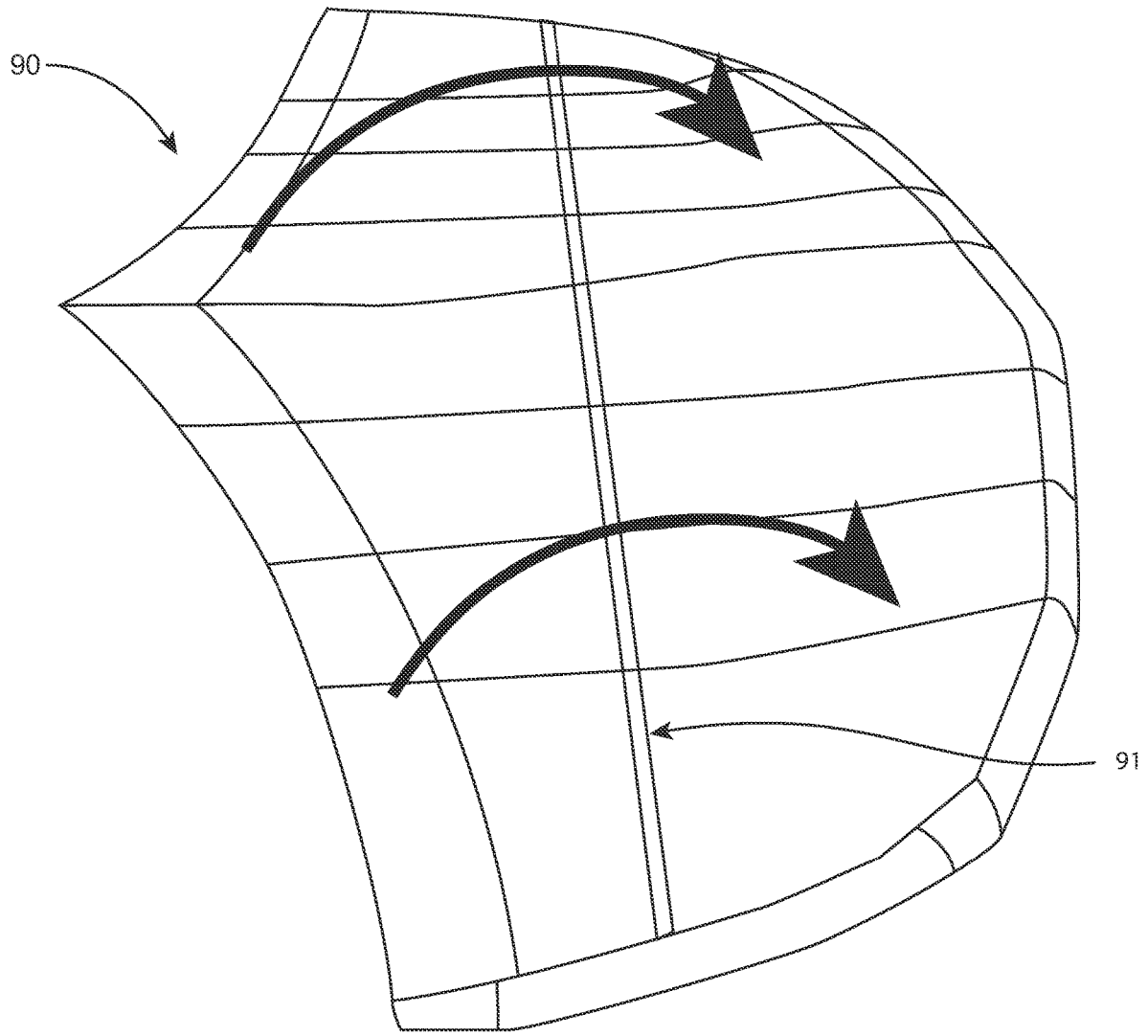
FIGS. 9A to 9B show perspective views of the wing of FIG. 4 being first folded lengthwise (from the open form in FIG. 9A to the folded form shown in FIG. 9B.
Figure 9B:
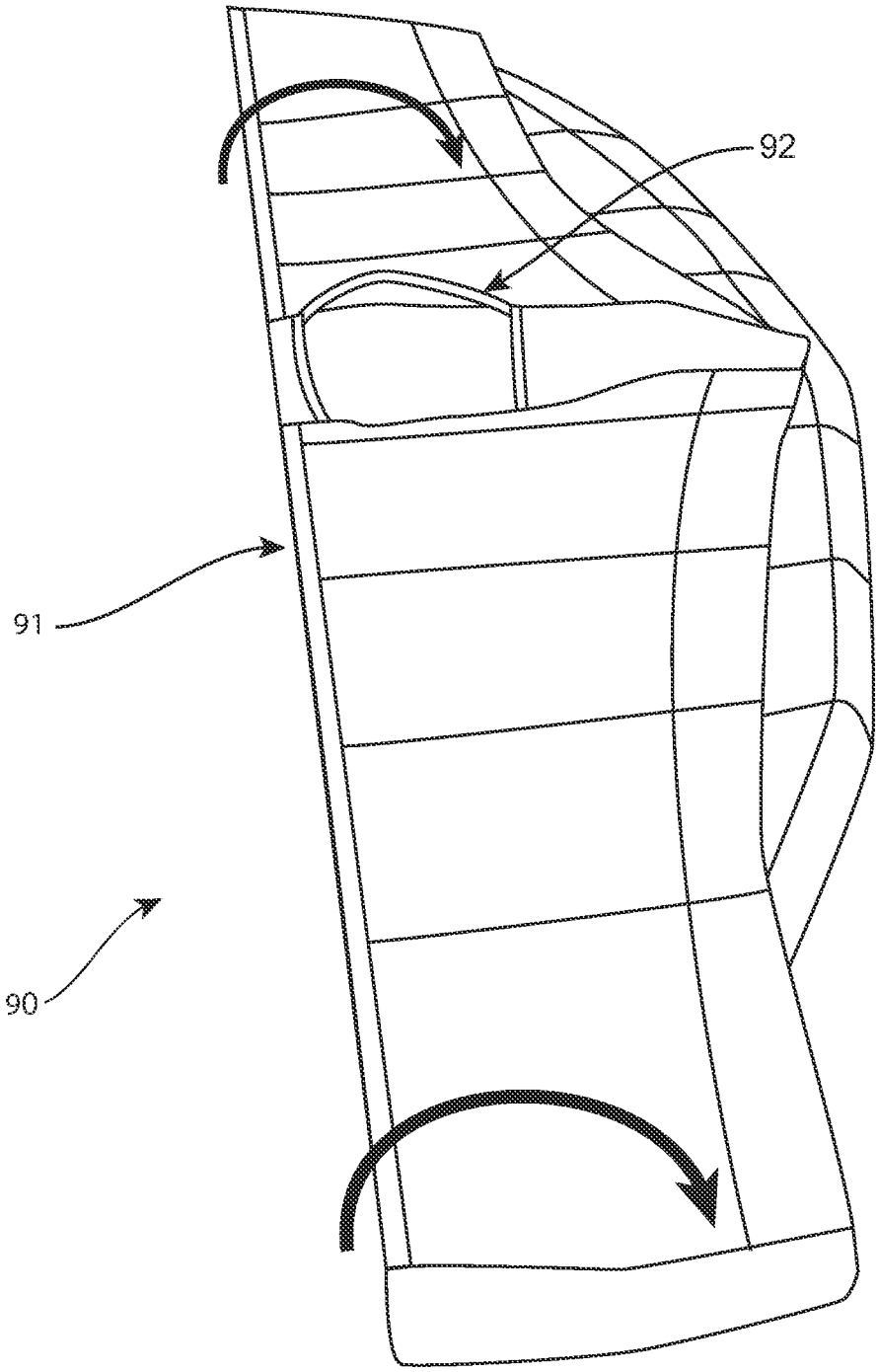
Figure 9C:
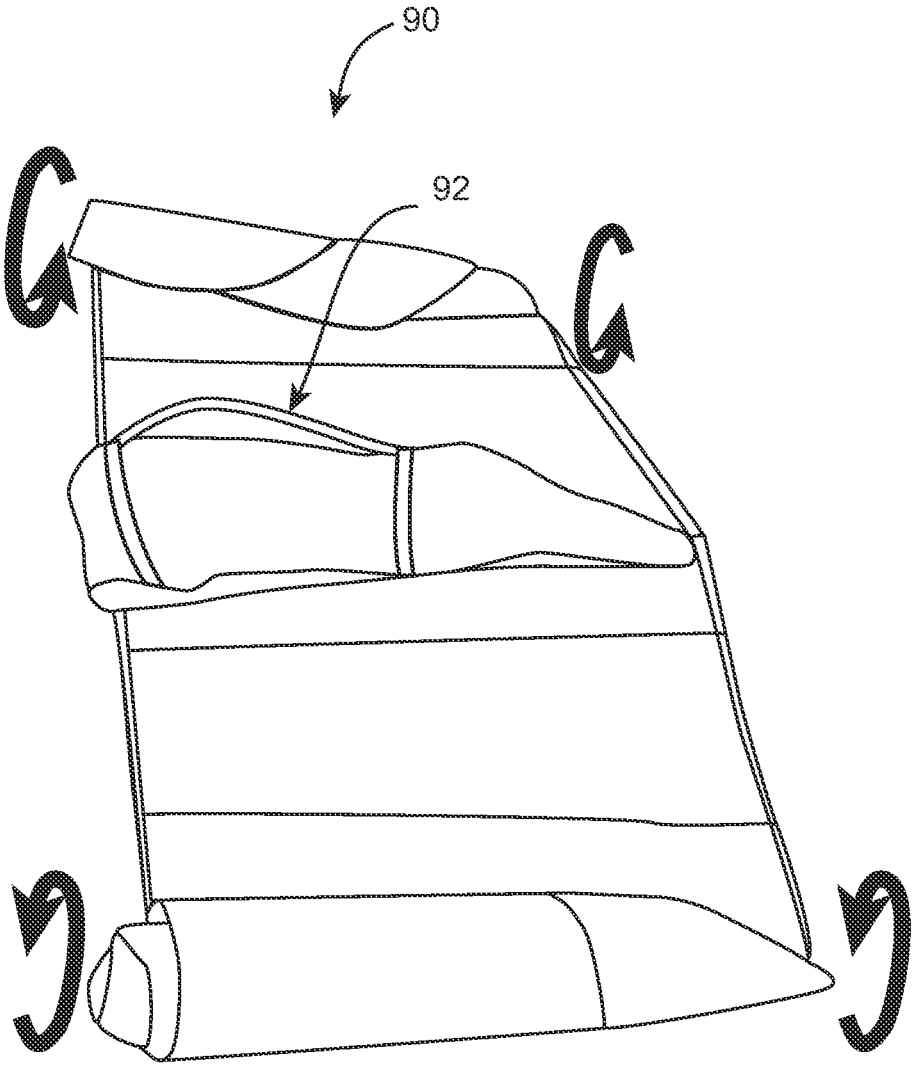
FIG. 9C illustrates rolling up the wing from opposite ends.

FIGS. 9A to 9C shows a wing 90 shaped like wing 40 or kite 70, and made of a laminate film material. To avoid damaging it while folding, it is first folded lengthwise (from the open form in FIG. 9A to the folded form shown in FIG. 9B) along strip 91 of foldable material, which is attached to adjacent sections of a laminate material. Then in FIG. 9C, the ends of the wing are rolled up towards the center. Handles 92 are attached to an inflatable center strut, further described for the embodiments in FIGS. 10-12 below.

After folding and rolling, the wing 90 will fit into a shorter package, i.e., one which is about one-half the length of a wing made entirely of laminate which cannot be folded without damaging it, and which does not include a lengthwise strip of foldable material like strip 91.

Figure 10:
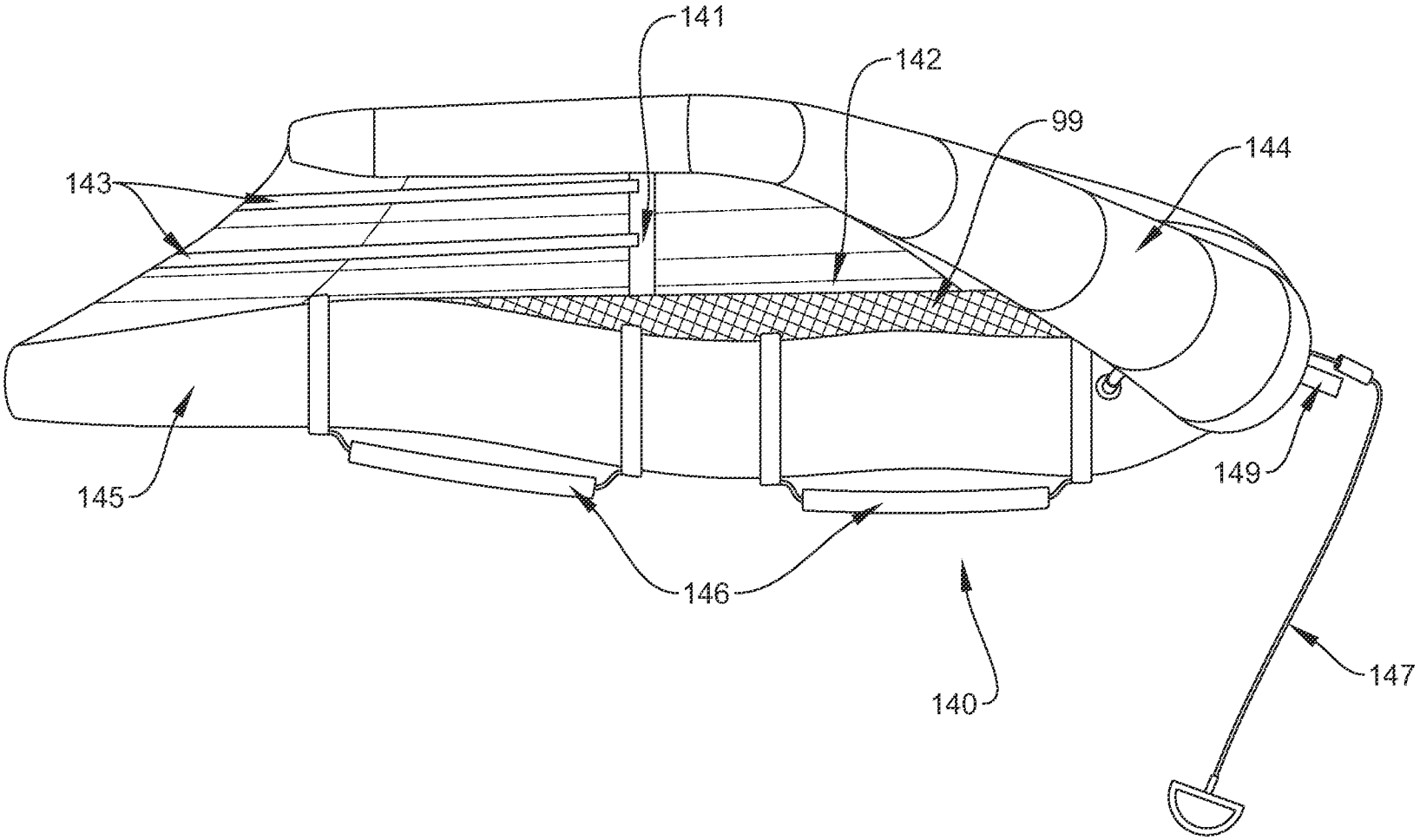
FIG. 10 is a side elevational view of a preferred wing of the invention.
Figure 11:
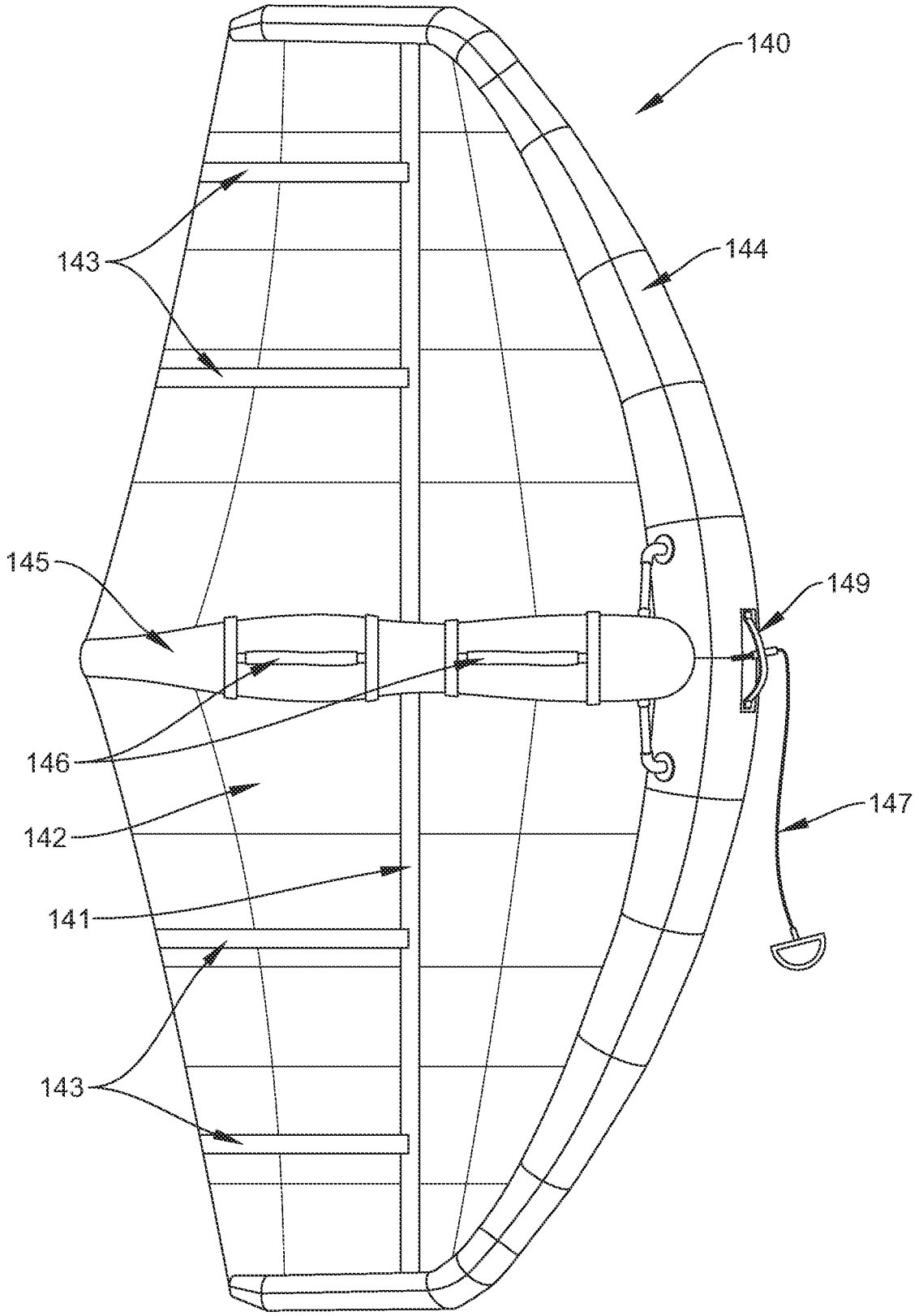
FIG. 11 is a plan view from the user side of a preferred wing of the invention.
Figure 12:
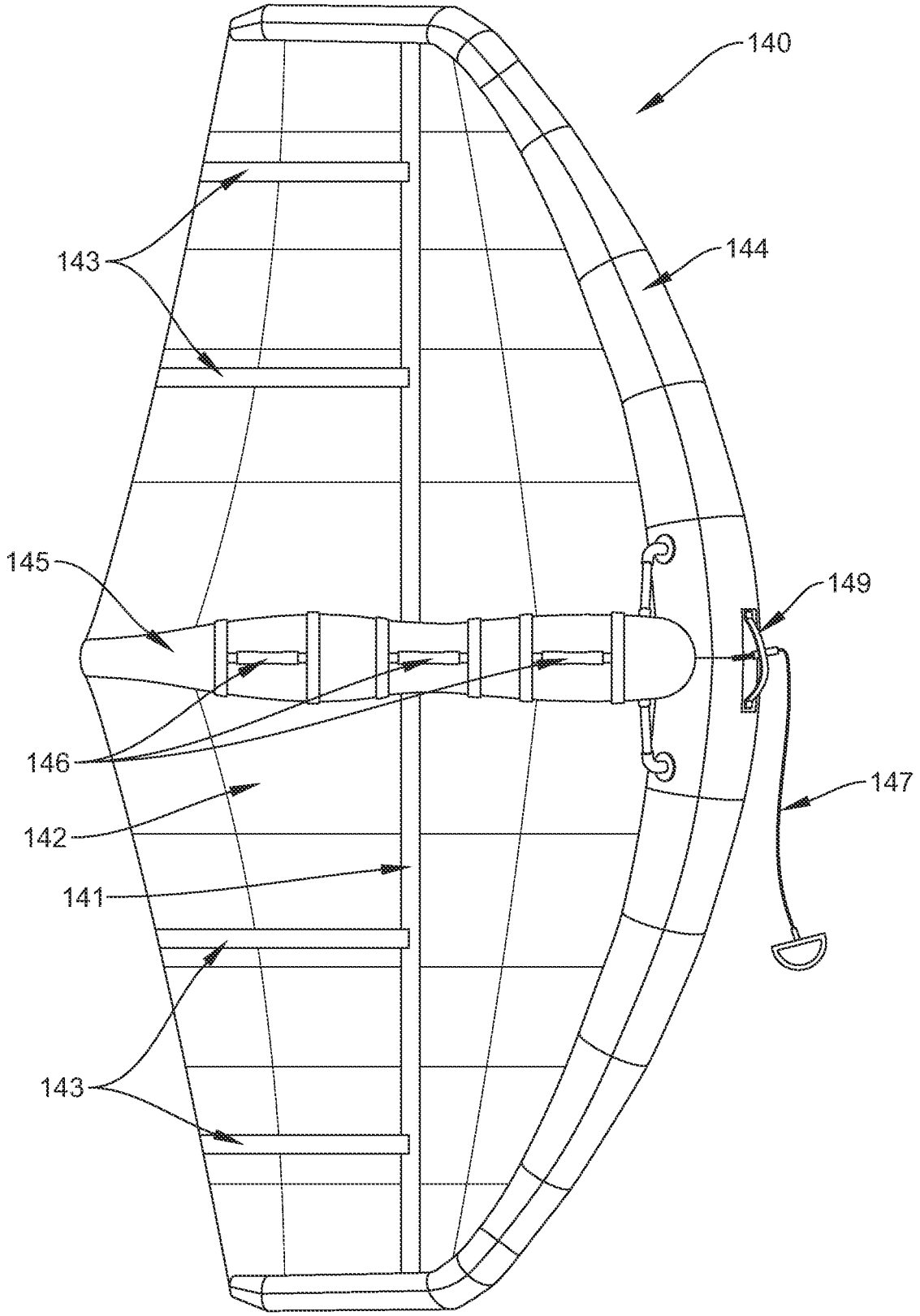
FIG. 12 is a plan view from the user side of another embodiment of a preferred wing of the invention.

FIGS. 10-12 show a most preferred wing 140 with a double-curved center strut 145, including two or more handles 146 attached to center strut 145, and with the sections of center strut 145 opposing handles 146 curving away from handles 146. Material 99 connects the adjacent side of laminate material 142 to center strut 145. Handle 149 is attached to the inflatable leading edge 144. In the embodiment of wing 140 in FIG. 10, there are two semi-rigid battens 143 and a longitudinal, foldable strip 141. The embodiment of wing 140 in FIG. 10 also has a leash 147 attached near or directly to leading edge 144.

Wing 140 is shown unfolded in FIG. 11, where the two transverse battens 143 on each side of center strut 145 and the longitudinal foldable strip 141 can be clearly seen, with the other features.

The embodiment of wing 140 in FIG. 12 is like that in FIGS. 10 and 11 but it includes three handles 146 attached to center strut 145. Handles 146 can have a removable cover (such as canvas) over a support, so that the cover can be replaced if worn. The S-shape of center strut 145 makes additional room under handles 146 to accommodate a user's hands more readily and more comfortably; even if a user is wearing gloves or mittens (which may be neoprene, for use in cold water or weather).

A number of variants of wing 140 in FIGS. 10-12 can be used under different conditions. For example, a low aspect ratio (wing length to width) offers more power and may be especially useful where the total wing area is reduced. A smaller wing area with a higher aspect ratio is preferred in higher winds. The wing of the invention can be readily adjusted to all such shapes, and maintain the advantages of reduced space for storage and transport.

The preferred laminate for wing 140 has another significant advantage in that it can be substantially transparent so as to allow the rider to see through it, and visually reference waves, shoreline, sky or hazards on the other side of the wing.

Folding the Wing Following Use

After use, the wing should preferably be dried before storage. The drying and folding steps are preferably done at a clean location. The wing can first be placed on the ground and dried on both sides. Then, from flat on the ground, the strut and leading edge housings are deflated. The wing should be free of debris as much as possible before folding, as the materials can be damaged by exposure to debris.

The folding begins by first folding the wing over lengthwise, as shown in FIGS. 9A, 9B, and then rolling in the wing ends as shown in FIG. 9C so the wing can be inserted in storage bag.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, any of the terms "comprising", "including", containing", etc. are to be read expansively and without limitation. The methods and processes illustratively described herein suitably may be practiced in differing orders of steps, and that they are not necessarily restricted to the orders of steps indicated herein or in the claims. It is also noted that as used herein and in the appended claims, the singular forms "a," "an," and "the" include plural reference, and the plural include singular forms, unless the context clearly dictates otherwise. Under no circumstances may the patent be interpreted to be limited to the specific examples or embodiments or methods specifically disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

The invention has been described broadly and generically herein. Each of the narrower species and subgeneric groupings falling within the generic disclosure also form part of the invention. The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

What is claimed is:

1. A wing for propulsion of a floating board or a board with a hydrofoil, comprising:

a leading edge formed by an inflatable housing attached to a canopy, such that the wing has two wingtips, one at each end of the leading edge and the canopy has a trailing edge; and wherein the canopy is made of a film material, the canopy further having one or more strips of flexible material between the leading edge and the trailing edge which can be folded without creasing, wherein the one or more strips of flexible material run parallel to a line between the two wingtips.

2. The wing of claim 1 wherein the flexible material can be weaved polyester or nylon fibers, polyvinyl chloride, polyurethane, polyethylene or any other flexible and foldable material.

3. The wing of claim 1 wherein the film is a laminate wherein woven fibers are glued between two layers of film or a single layer of film.

4. The wing of claim 1 wherein the film material will crease and damage if folded.

5. The wing of claim 1 further including a center strut formed of an inflatable housing extending transverse to the one or more strips of flexible material.

6. The wing of claim 5 wherein the center strut bisects the canopy into two equal sections.

7. The wing of claim 5 wherein the center strut inflatable housing is fluidly connected with the leading edges' inflatable housing.

8. The wing of claim 5 further including one or more handles attached to the center strut.

9. A method of preparing the wing of claim 1 for storage or transport, comprising:

deflating the inflatable housing;

folding the canopy along the one or more strips of flexible material; and rolling up the canopy from a wingtip.

10. A method of preparing the wing of claim 5 for storage or transport, comprising:

deflating the inflatable housing and the center strut;

folding the canopy along the one or more strips of flexible material; and rolling up the canopy from each wingtip towards the center strut.

* * * * *